US005436604A

United States Patent [19]

Mrenna et al.

[11] Patent Number: 5,436,604

[45] Date of Patent: Jul. 25, 1995

[54] MOLDED CASE FOR A MINIATURE CIRCUIT BREAKER

[75] Inventors: Stephen A. Mrenna, Brighton Township, Beaver County; Richard W. Weaver, North Sewickley Township, both of Pa.

[73] Assignee: Eaton Corporation, Cleveland, Ohio

[21] Appl. No.: 257,987

[22] Filed: Jun. 10, 1994

[51] Int. Cl.[6] ..... H01H 9/02

[52] U.S. Cl. ..... 335/202; 200/303

[58] Field of Search ..... 200/293, 293.1, 302.1, 200/302.3, 303, 304, 305; 335/202

[56] References Cited

U.S. PATENT DOCUMENTS 4,933,653 6/1990 Mrenna et al. ..... 335/37

5,008,645 4/1991 Mrenna ..... 337/70

5,151,671 9/1992 Hirao et al. ..... 335/167

*Primary Examiner*—Lincoln Donovan

*Attorney, Agent, or Firm*—Martin J. Moran

[57] ABSTRACT

A molded case for a miniature circuit breaker provides a base and a cover whose outer mating peripheral walls, which form and enclose a cavity for housing a circuit breaker mechanism, have approximately equal widths, except for the projected handle area. In this handle area, the width of the peripheral wall of the base is increased and contains an aperture for receiving the handle, and the width of the peripheral wall of the cover is decreased to receive the increased aperture area of the base. This arrangement provides for full handle support in the base for ease of assembly; high ribbing for maximum strength for short circuits; and a minimum overall thickness of about 0.500 inches.

9 Claims, 4 Drawing Sheets

FIG. 6
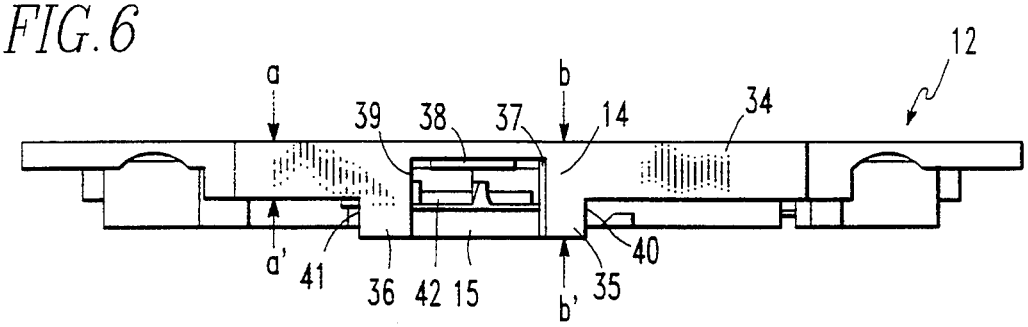
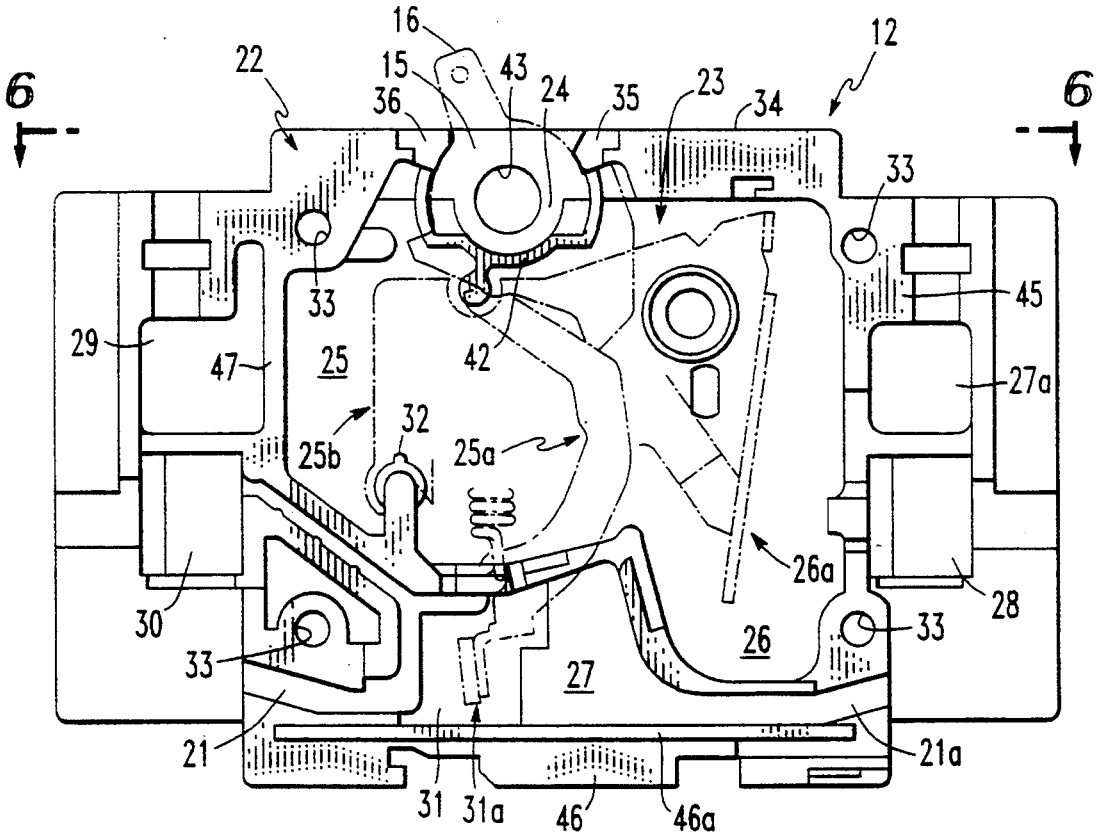
FIG. 5

FIG. 8
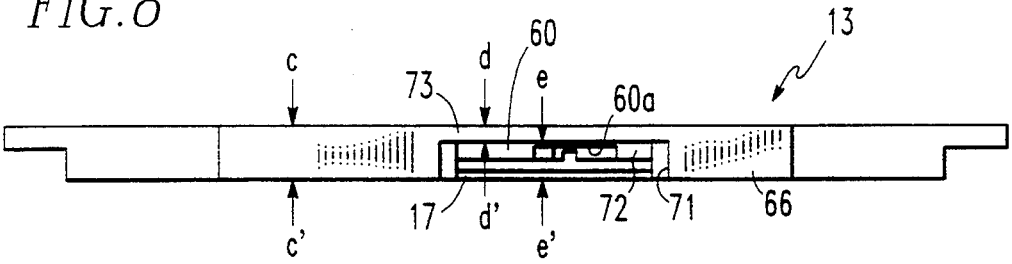
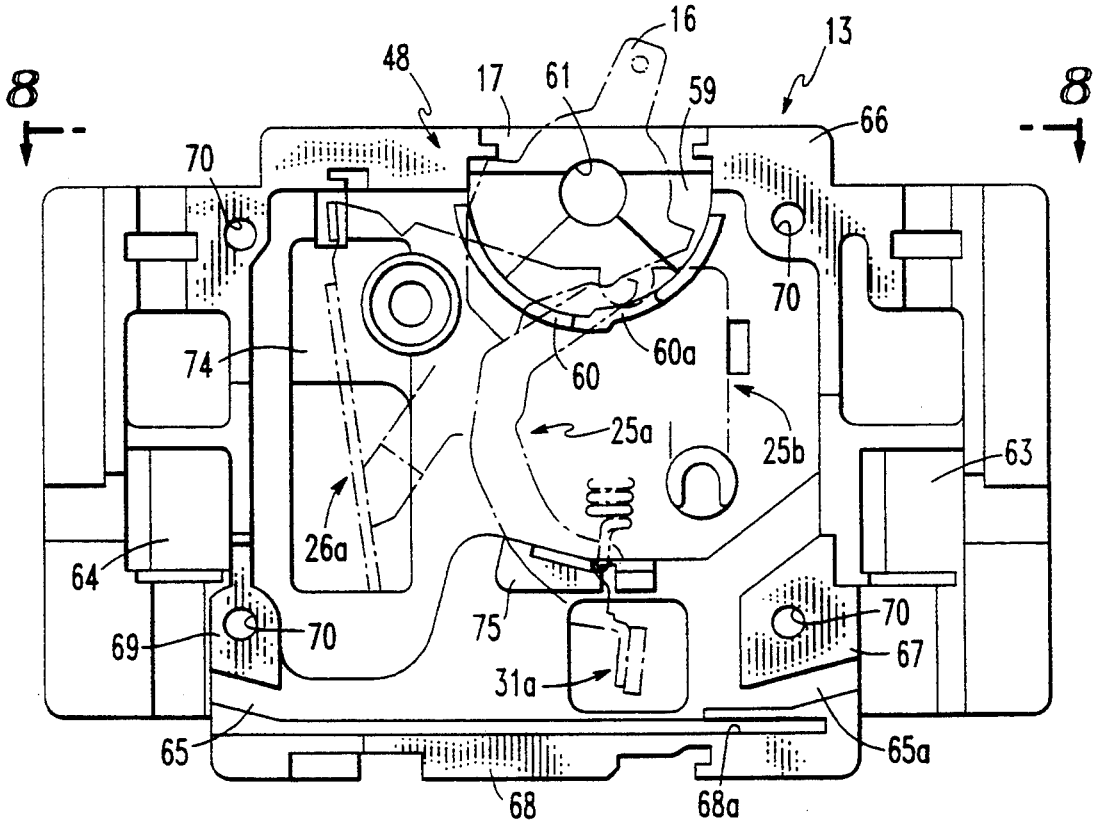
FIG. 7

MOLDED CASE FOR A MINIATURE CIRCUIT BREAKER

CROSS REFERENCE TO RELATED APPLICATION

The invention taught herein is related to a concurrently fried, commonly assigned pending application Serial No. 08/257,488 entitled "Handle Barrier in a Molded Case for a Miniature Circuit Breaker" by Stephen A. Mrenna (Attorney Docket No. 58,239).

BACKGROUND OF THE INVENTION

1. Field of the Invention

This invention relates to a miniature circuit breaker, and more particularly, to a molded case having a base and a cover designed to provide equal strength in the base and in the cover for optimum overall strength which becomes important when a short circuit occurs; full handle member support in the base for easy assembly of the circuit breaker; and a reduced overall thickness for the base and cover assembly.

2. Background Information

Present designs for a molded case for a miniature circuit breaker take various forms for accommodating the handle part of an operating mechanism for the circuit breaker. One such design for a molded case provides for a base whose peripheral walls are relatively wide accounting substantially for the overall thickness of the assembled molded case, and the cover is relatively thin accounting very little for the overall thickness of the assembled molded case. In this molded case design, the handle part is substantially supported in an aperture formed in the base which may allow for easy assembling of the components in the base of the circuit breaker. However, under some conditions, the relatively thin cover may have a tendency to break away from the base or fly off of the base when a short circuit or an overcurrent occurs due to the buildup of gas pressure in the molded case.

A further design for a molded case for a miniature circuit breaker of the prior art involves a base and a cover whose peripheral walls have substantially equal widths, whereby the handle part of the operating mechanism is supported equally in both the base and in the cover. In this design, part of the aperture for the handle part is in the base, and part of the aperture is in the cover. This makes assembling of the components for the circuit breaker mechanism, comprising a handle part, a cradle, a spring, and a contact arm, somewhat difficult in that the spring biased handle part tends to cock and if the handle bearing is not completely in place in the base, which normally happens in this type of molded case design, the components pop out of the base. This design also does not provide close enough tolerances between the handle and the assembled molded case to prevent the flame and hot gases from escaping when an arc interruption occurs. This design has structural limitations in that if the tolerances were made any closer, the bearing on the handle part would rub with the other parts of the assembled case.

Both these prior art molded case designs are generally about 1.00 inch thick in assembled form and may be adequate for certain installations and amperage interruption requirements, but do not allow the overall thickness of the molded case to be minimized and still provide the strength and integrity for a relatively thin, single pole miniature circuit breaker.

There remains a need, therefore, for an improved case design for a miniature circuit breaker whereby the overall thickness of the assembled molded case can be even less than previously, including an improved aperture design for the handle part.

There also remains a need for an improved case design which is relatively thinner than the previous molded case design and which provides the strength and integrity for a single pole miniature circuit breaker.

And still further, there remains a need for an improved case design for a miniature circuit breaker which provides ease in assembly of the components of the circuit breaker in the base.

SUMMARY OF THE INVENTION

These and other needs are satisfied by the present invention which provides for an assembled molded case for a miniature circuit breaker having an overall thickness of about 0.500 inch or less. The peripheral walls of the base and the cover are substantially equal in width, except for the aperture area containing the handle part. In this aperture area, the peripheral wall in the base is large enough to accommodate the entire handle part. The peripheral wall in the cover is slightly receded or less than the rest of the peripheral walls for the cover and receives the enlarged area of the base and encloses the handle part in the base.

This design for a molded case provides for equal widths of the ribbing system in both the base and the cover, the width for each being about 0.245 inches resulting in the overall molded case thickness of about 0.500 inch or less. Additionally, this design provides close tolerances between the handle part and the formed aperture in the peripheral walls of the base and the cover, and provides ease of assembly in view of the handle part being fully supported in the base which prevents the load sprung mechanism of the operating mechanism from flying apart before the cover is installed.

It is, therefore, an object of the present invention to provide an improved design for a molded case for a single pole miniature circuit breaker which minimizes the overall dimension for the assembled molded case, which maximizes the strength and integrity of the circuit breaker, and which minimizes the tolerances between the handle member and the aperture in the molded case.

It is a further object of the present invention to provide an improved molded case design for a miniature circuit breaker which eliminates most of the coring on the outer surfaces of both the base and the cover which, in addition to the relatively thin dimension of the assembled case, allows a greater number of single pole circuit breakers to be compactly arranged in a given amount of space.

A still further object of the present invention is to provide an improved molded case design for a miniature circuit breaker having a more simplified design for the bearing surfaces of the handle part and for the aperture in the base for receiving the handle part, thereby creating ease of assembly of the spring biased components of the circuit breaker mechanism in the base.

It is a further object of the present invention to provide a molded case for a circuit breaker which provides a base and a cover having equal widths, with the base having an aperture area which fully receives and supports the handle part of the operating mechanism, and with the base and cover having an equal strength safety factor.

A further object of the present invention is to provide a molded case for a single pole circuit breaker which is relatively thinner than prior art designs thereby allowing at least two single pole circuit breakers to be installed in a space normally occupied by only one single pole circuit breaker.

These and other objects of the present invention will be more fully understood and appreciated from the following description of the invention, on reference to the illustrations appended hereto.

BRIEF DESCRIPTION OF THE DRAWINGS

FIG. 5 is an elevational view looking inside the base of the circuit breaker of FIG. 3 with the cover and the components of the circuit breaker mechanism removed;

FIG. 6 is a view taken along lines 6—6 of FIG. 5;

FIG. 7 is an elevational view looking inside the cover prior to it being assembled onto the base; and FIG. 8 is a view taken along lines 8—8 of FIG. 7.

DESCRIPTION OF THE PREFERRED EMBODIMENT

Figure 1:
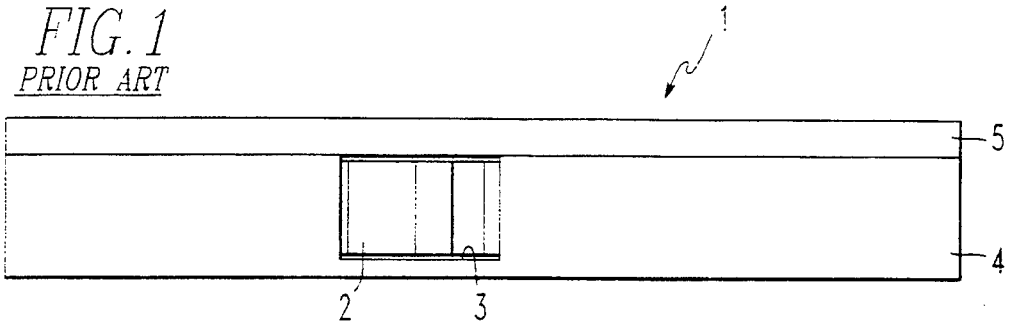
FIG. 1 PRIOR ART
FIG. 1 is a front elevational view showing a design for a case assembly for a circuit breaker of the prior art where an aperture in a thick base fully receives a handle and a thin cover encloses the handle in the base.
Figure 2:
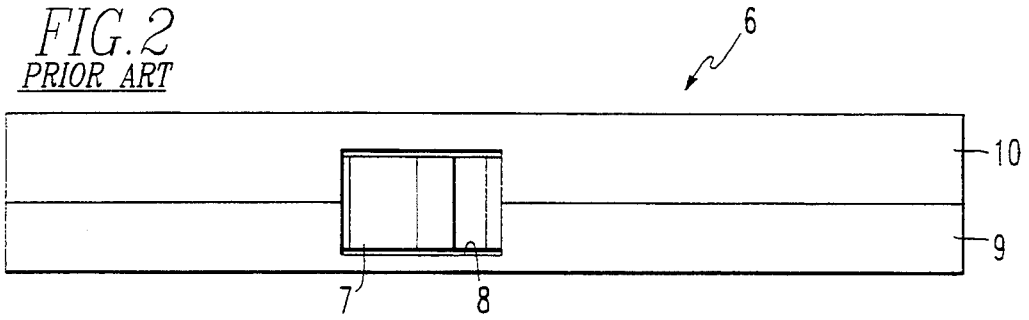
FIG. 2 PRIOR ART
FIG. 2 is a front elevational view showing a further design for a case assembly for a circuit breaker of the prior art where part of an aperture for a handle is formed in a base and part of the aperture is formed in a cover, and where the cover and the base have equal widths.

Referring first to FIGS. 1 and 2 of the prior art, FIG. 1 illustrates an example for a molded case for a circuit breaker where the handle part 2 is fully received in an aperture 3 formed in base 4, and cover 5 encloses the aperture 3 and handle part 2. The width of base 4 is substantially greater than that of cover 5. The overall thickness for circuit breaker 1 is about 1.00 inch in assembled form with the peripheral walls and ribbing system in base 4 being about 0.75 inch and that for cover 5 being about 0.25 inches. In this design, base 4 totally forms aperture 3 for receiving and supporting handle 2.

FIG. 2 illustrates a further example for a molded case for a circuit breaker 6 of the prior art where handle part 7 is received in an aperture 8 which is partially formed in base 9 and partially formed in cover 10.

The overall thickness for circuit breaker 6 is about 1.00 inch in assembled form with the peripheral walls and the ribbing system in the base 9 being about 0.50 inches and that for cover 10 being about 0.50 inches.

These FIGS. 1 and 2 schematically represent the prior art designs discussed in the background section of this application, and have the disadvantages discussed therein.

Figure 3:
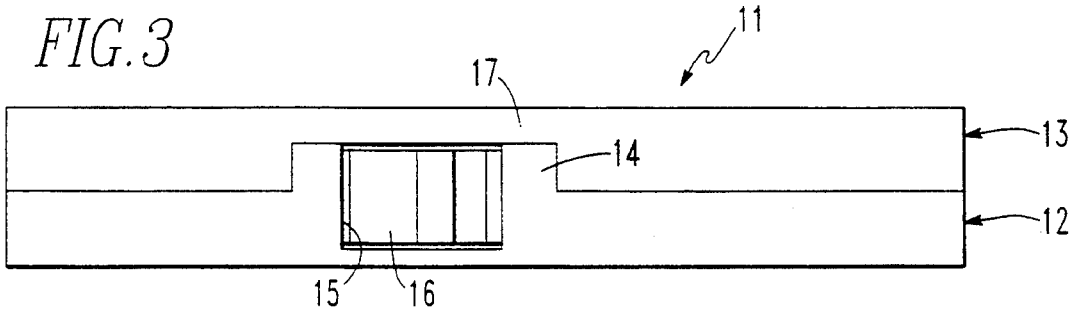
FIG. 3 is a front elevational view schematically showing a case assembly with a base and cover of the present invention.

FIGS. 3,4,5,6,7, and 8 illustrate a molded case design of the present invention and may involve a miniature circuit breaker of the type with a current interrupting rating of 10,000 amperes at 120/240 volts AC, with FIG. 3 schematically illustrating the invention to show one of the main differences between the case design of the present invention and the prior art case designs of FIGS. 1 and 2.

Figure 4:
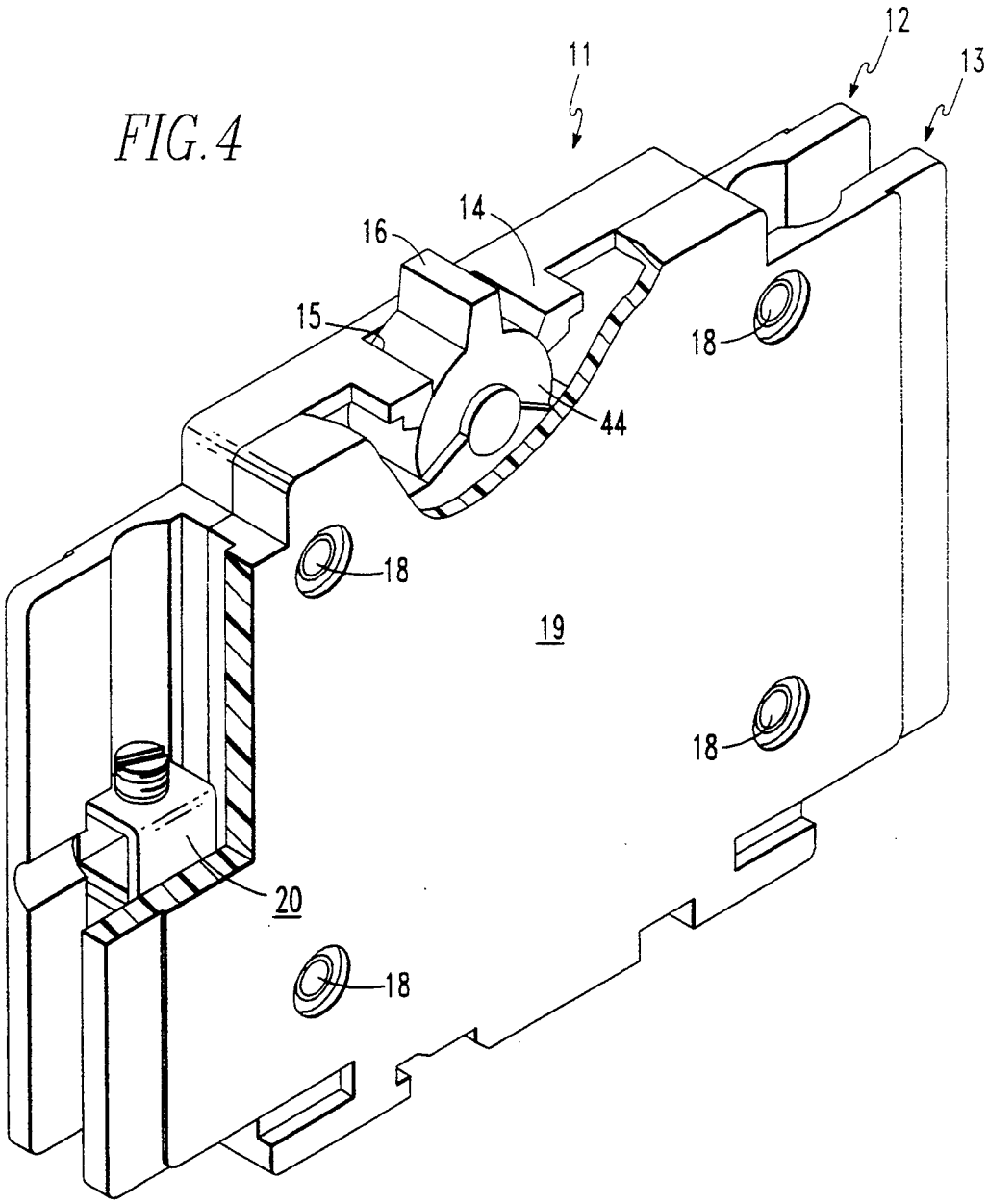
FIG. 4 a perspective view of a circuit breaker in accordance with the present invention and is partially broken away to show the handle part with its bearing surfaces on one side thereof positioned in the base.

In FIG. 4, the circuit breaker 11 comprises an electrically insulating housing or case, which has molded insulating base 12, and molded insulating cover 13 which are secured together by rivets 18, which are recessed in both cover 13 and base 12. These rivets 18 project through the top outer surface 19 of cover 13 and project through the top outer surface of base 12, not shown. As shown in FIG. 4, top outer surface 19 of cover 13 is relatively smooth and free of any coring. Even though not shown, the top outer surface of base 12 is also relatively smooth and free of any coring. This feature of the top outer surface 19 and cover 13 and base 12, along with the relatively thin thickness of the molded case for circuit breaker 11, more of which will be discussed hereinbelow, allows a greater number of miniature circuit breakers to be compactly arranged in a given amount of space, for instance, in a load center, as compared to miniature circuit breakers of the prior art. For instance, since the overall thickness for single pole prior art circuit breakers is about 1.00 inch, the present invention allows at least two single pole circuit breakers to be installed in the same space in view of their being less than $\frac{1}{2}$ inch thick.

As is also shown in FIG. 4, the design of the case for circuit breaker 11 positions the electrical terminals, one of which is indicated at numeral 20 relatively outside of the case. As shown in FIG. 5, channels or gas vents 21 and 21*a* below each of the electrical terminals when assembled in the circuit breaker 11, allows the gases developing in the case to escape into the atmosphere. Handle part 16 extends through aperture 15 in aperture area 14 of base 12 on top of the case to enable manual operation of the circuit breaker 11. Aperture area 14 along with the design of base 12 and that of cover 13 for accommodating aperture area 14 and handle part 16 involves the essence of the present invention.

FIGS. 5 and 6 illustrate base 12 of the present invention before the components of the circuit breaker mechanism are installed. Base 12 is a molded one-piece member with an integrally formed raised ribbing system 22 which, as is known in the art, generally forms a cavity for the circuit breaker mechanism and includes portions for supporting and/or forming different compartments or areas such as that indicated at numerals 24,25,26,27,28,29,30, and 31 for receiving and positioning the several components of a circuit breaker mechanism, only some of which components are shown in phantom in FIG. 5 for clarity purposes. For instance, the arcuate area 24 positions the handle part 16. Area 25 positions a latchable operating mechanism 25*a* which is spring biased to the handle part 16 and a stationary support plate 25*b* which is supported on post 32 which is part of ribbing system 22. Compartment 26 supports a cradle 26*a*. Areas 28 and 30 position the load and line electrical terminals, one indicated at 20 in FIG. 4. Area 31 receives a set of electrical contacts 31*a* for the load and line terminals and a metallic shield for the arc interruption. These and other components of the circuit breaker mechanism are assembled and placed in the several areas formed by the ribbing system in a manner similar to that shown in U.S. Pat. Nos. 4,933,653 and 5,008,645 assigned to the same assignee as this application, which U.S. Pat. Nos. 4,933,653 and 5,008,645 are incorporated herein by reference.

Ribbing system 22 also forms channels 21 and 21*a* for the escape of gases into the atmosphere, and includes outer peripheral walls which essentially form main cavity 23 for the circuit breaker mechanism, and which contain apertures 33 for receiving rivets 18 of FIG. 4.

The configuration of outer peripheral wall 34 from which handle part 16 protrudes is best shown in FIG. 6. The width of peripheral wall 34 is generally the same dimension as the rest of the peripheral walls of base 12 forming cavity 23 except for the increased or enlarged portions 35 and 36 which are part of enlarged area 14 which form a generally rectangular opening or aperture 15, and which aperture 15 has inner surfaces 37,38 and 39, and which enlarged area 14 has outer surfaces 40 and 41. Another portion of the fibbing system 22 is indicated at numeral 42 in aperture 15 of FIG. 6, located inwardly of peripheral wall 34 and aperture 15. This ribbing portion 42 is a barrier member which receives and overlaps a portion of the handle part 16 when handle part 16 is placed into arcuate area 24, and as shown best in FIG. 5 barrier member 42 is in a generally arcuate configuration and borders arcuate area 24, which, in turn, has a circular coring 43. This arcuate area 24 and coring 43 corresponds to a bearing surface of handle part 16 similar to that shown at numeral 44 in FIG. 4.

Referring to FIG. 6, the width of peripheral wall 34 indicated by a—a′ is about 0.245 inches, and the width of enlarged portions 35 and 36 of enlarged area 14 as indicated by b—b′ is about 0.450. The remaining peripheral walls 45, 46 and 47 around cavity 23 (FIG. 5) terminate into mating surfaces (not numbered) and the width of these peripheral walls 45, 46 and 47 are about 0.245, essentially the same as that of peripheral wall 34 at a—a′. Peripheral wall 46 also has tongue element 46*a* extending along its length.

FIGS. 7 and 8 illustrate cover 13 of the present invention prior to its being secured to base 12 once the components of the circuit breaker mechanism have been assembled and fixed in base 12. Cover 13 is a molded one-piece member with an integrally formed raised ribbing system 48, which has parts which correspond to and cooperate with those of the ribbing system 22 of base 12 of FIGS. 5 and 6, to form the cavity and compartments for receiving and positioning the several components of the circuit breaker mechanism. For instance, arcuate area 59 with coring 61 receive bearing surface 44 of handle part 16. Areas 63 and 64 aid in holding the electrical terminals, and passageways 65 and 65*a* in cover 13 cooperate with base 12 to form channels 21 and 21*a* of FIG. 5. Arcuate barrier member 60 borders arcuate area 59 and cooperates with barrier member 42 in base 12 to overlap the bearing surfaces on both sides of handle part 16 to separate the main cavity 23 from the aperture 15 but still allow handle part 16 to extend down into main cavity 23 for its connection to the components of the circuit breaker mechanism as shown in phantom in FIGS. 5 and 7. Barrier member 60 has a cut-out portion 60*a* which provides a clearance for the handle part 16 and its connection to the remaining components of the circuit breaker mechanism. The width of barrier members 42 and 60 is about 0.156 and 0.125 inches, respectively. Both barrier members 42 and 60 are spaced away from the rounded end of handle part 16 when the circuit breaker mechanism is assembled in the molded case. This allows handle part 16 to freely rotate without any interference from barrier members 42 and 60.

Ribbing system 48 of cover 13 includes outer peripheral walls 66, 67, 68 and 69, which contain apertures 70 for receiving rivets 18 of FIG. 4, and which cooperate with the outer peripheral walls 34, 45, 46, and 47, respectively, of base 12 to form and enclose the cavity 23 of base 12 containing the circuit breaker mechanism, some of which components are shown in phantom and which are those components shown in FIG. 5.

The configuration of outer peripheral wall 66 of cover 13, which cooperates with outer peripheral wall 34 of base 12 of FIGS. 5 and 6 is shown in FIG. 8. The width of outer peripheral wall 66 is generally the same dimension as the remaining peripheral walls 67, 68, and 69, except for the recessed area 17, which generally forms a rectangular opening having inner surfaces 71, 72 and 73.

Another portion for the ribbing system 48 of cover 13 is indicated at numeral 75 in FIG. 7. In referring again to FIG. 8, the width of outer peripheral wall 66 indicated at c—c′ is about 0.245 inches, and the width of outer peripheral wall 66 at the recessed area 17 indicated at d—d′ is about 0.080 inches, with the width of recessed area 17 at e—e′ being about 0.165 inches. The remaining outer peripheral walls 67, 68 and 69 of cover 13 are also about 0.245 inches wide and terminate into mating surfaces (not numbered). This width for peripheral walls 66, 67, 68, and 69 of cover 13 is essentially the same dimension as that of outer peripheral walls 45, 46 and 47 of base 12 and peripheral wall 34 at a—a′. As shown in FIG. 7, peripheral wall 68 has a groove 68*a* along its length for receiving the tongue element 46*a* in peripheral wall 46 of base 12 when the base 12 and cover 13 are assembled.

The length of recessed area 17 in outer peripheral wall 66 of cover 13 is about 0.900 inches which is slightly greater than the length of enlarged area 14 in outer peripheral wall 34 of base 12 so that enlarged area 14 closely fits into recessed area 17, and the length and width of aperture 15 of outer peripheral wall 34 of base 12 are about 0.500 and 0.330 inches, respectively, and handle part 16 fits closely into aperture 15, with very close tolerances therebetween.

When cover 13 is assembled onto base 12 in the manner shown in FIG. 4, the mating surfaces of peripheral walls 66, 67, 68, and 69 of cover 13 abuts against the mating surfaces of peripheral walls 34, 45, 46, and 47 with the mating surfaces 71, 72, and 73 of recessed area 17 in outer peripheral wall 66 of cover 13 abutting against mating surfaces 37, 38, and 39 of enlarged area 14 of base 12. Outer peripheral wall 66 of cover 13 extends across aperture 15 containing handle part 16 to enclose handle part 16 in aperture 15 in a manner similar to that shown in FIG. 3 where there exists a minimum clearance or a clearance of very close tolerances between handle part 16 and recessed area 17 at area e—e′ as shown in FIG. 8. It has been shown that these close tolerances meet the U.L (Underwriter's Laboratories) requirements in that during testing of the present invention, a cotton swab was not set afire, which is normally the case when the tolerances are not close enough, the flame being caused by an arc interruption on a short-circuit.

The overall thickness or width of circuit breaker 11 is about 0.490 or less than 0.500 inches since peripheral walls 34, 45, 46, and 47 of base 12 are about 0.245, and peripheral walls 66, 67, 68, and 69 of cover 13 are about 0.245.

Being that handle part 16 fits fully into and is adequately supported by aperture 15 in base 12, the components of the circuit breaker mechanism of circuit breaker 11 including the spring biased mechanism can easily be installed and/or mounted into the base, and cover 13 attached thereto. Also, the ribbing system 22 of base 12 and the ribbing system 48 of cover 13 essentially have the same width of 0.245 inches, making an overall thickness of less than 0.500 inches for the circuit breaker 11, thereby providing maximum strength for the circuit breaker 11, which is an important factor when a short circuit occurs.

Both base 12 and cover 13 may be made of a glass polymer material or a plastic material. Since the overall thickness of the base 12 is essentially the same as that of cover 13, both base 12 and cover 13 have an equal strength safety factor whereby the base and the cover remain assembled together even when there is a buildup of gases in the molded case caused by a short circuit or an overcurrent.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

In accordance with the provisions of the patent statutes, we have explained the principle and operation of our invention and have illustrated and described what we consider to be the best embodiment thereof.

We claim:

1. A molded case for a circuit breaker with a handle part projecting from said circuit breaker for manual operation of the circuit breaker mechanism in said case, said case comprising:

a base with first outer peripheral walls forming a cavity for housing said circuit breaker mechanism, and having a width which terminates into first mating surfaces, and a cover with second outer peripheral walls, having a width which terminates into second mating surfaces, and which said second mating surfaces contact said first mating surfaces of said base when in assembled form to enclose said cavity containing said circuit breaker mechanism, said base including an enlarged area in one of its said first outer peripheral walls, said enlarged area having aperture means for receiving and substantially supporting said handle part of said circuit breaker mechanism in said base, said cover including a recessed area in one of its said outer second peripheral walls which receives said enlarged area of said base and which extends parallel to said aperture means in said enlarged area of said base to enclose said handle part in said base, and said width of said first outer peripheral walls of said base being substantially the same dimension as said second outer peripheral walls of said cover, except for said enlarged area of said base which has an increased width, and said recessed area in said cover which has a decreased width which receives said enlarged area of said base and said handle part when said cover and said base are in said assembled form.

2. A molded case of claim 1, wherein said base and said cover in said assembled form create an overall thickness for said molded case of said circuit breaker, and wherein said base includes a fibbing system for forming said cavity and said cover includes a fibbing system corresponding to said fibbing system of said base, and wherein said fibbing system of said cover is approximately half of said overall thickness of said case, and said fibbing system of said base is approximately half of said overall thickness of said case.

3. A molded case of claim 2, wherein said overall thickness of said case is not more than about 0.500 inches and wherein said fibbing system of said base and said fibbing system of said cover each have an approximate width of 0.245 inches.

4. A molded case of claim 2, wherein said overall thickness of said case is less than 0.500 inches.

5. A molded case of claim 1, wherein said enlarged area in said base containing said aperture and receiving said handle part and wherein a portion of said recessed area in said cover located adjacent to said handle part have a minimum clearance therebetween.

6. A molded case of claim 1, wherein said cover and said base are made of a glass polyester material.

7. A molded case of claim 1, wherein said cover and said base are made of plastic material.

8. A molded case of claim 1, wherein said base and said cover have an equal strength safety factor.

9. A molded case of claim 1, wherein said base and said cover have a relatively smooth outer top surface with little or no coring.

* * * * *